United States Patent [19]

Pellerin

[11] 4,295,458

[45] Oct. 20, 1981

[54] DEVICE FOR INCREASING THE UNIFORMITY OF THE AIR-FUEL MIXTURE IN INTERNAL COMBUSTION ENGINES

[76] Inventor: Albert Pellerin, 35 rue Lambrechts, 92400 Courbevoie, France

[21] Appl. No.: 48,372

[22] Filed: Jun. 14, 1979

Related U.S. Application Data

[62] Division of Ser. No. 851,971, Nov. 16, 1977, Pat. No. 4,177,780.

[30] Foreign Application Priority Data

Nov. 16, 1976 [FR] France ..... 76 34414

[51] Int. Cl.[3] ..... F02M 29/00

[52] U.S. Cl. ..... 123/590; 123/591; 123/593; 123/548; 48/180 R; 48/180 B

[58] Field of Search ..... 123/590, 591, 593, 548; 261/78 R, 79 R; 48/180 R, 180 M, 180 B

[56] References Cited

U.S. PATENT DOCUMENTS

| | | | |
|---|---|---|---|
| 1,118,919 | 12/1914 | Canda | 48/180 R |
| 1,132,351 | 3/1915 | Jenkins | 48/180 R |
| 1,509,718 | 9/1924 | Depotie | 48/180 R |

FOREIGN PATENT DOCUMENTS

| | | |
|---|---|---|
| 524641 | 12/1953 | Belgium . |
| 1014788 | 8/1957 | Fed. Rep. of Germany . |
| 775641 | 1/1935 | France . |
| 95017 | 3/1970 | France . |
| 2287589 | 5/1976 | France . |
| 2290580 | 6/1976 | France . |
| 385080 | 12/1932 | United Kingdom . |
| 412782 | 7/1934 | United Kingdom . |
| 479892 | 2/1938 | United Kingdom . |
| 1239823 | 7/1971 | United Kingdom . |
| 1337828 | 11/1973 | United Kingdom . |

*Primary Examiner*—Ira S. Lazarus

*Attorney, Agent, or Firm*—Young & Thompson

[57] ABSTRACT

A device for increasing the uniformity of the air-fuel mixture in internal combustion engines, comprises a hollow truncated cone having a collar about its major opening, the collar being disposed between the carburetor flange and the manifold flange of the internal combustion engine. The cone extends into the manifold inlet and is perforated and has a member therein secured to its internal wall, that directs the mixture from the carburetor against the internal wall of the truncated cone.

4 Claims, 6 Drawing Figures

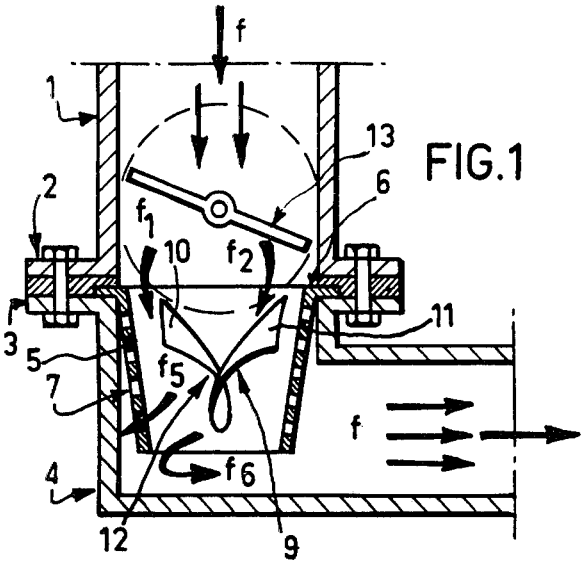
FIG.1
FIG.2
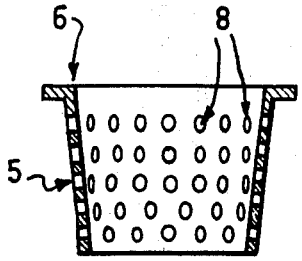
FIG.3
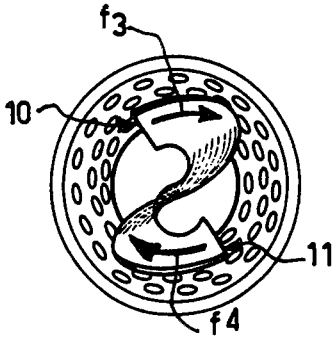
FIG.4
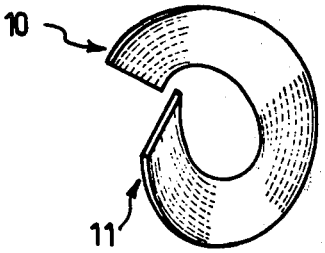
FIG.5
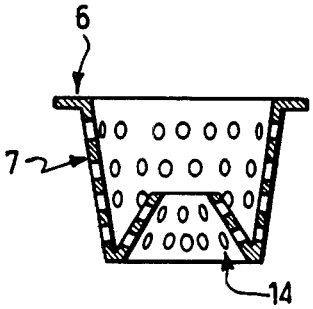
FIG.6
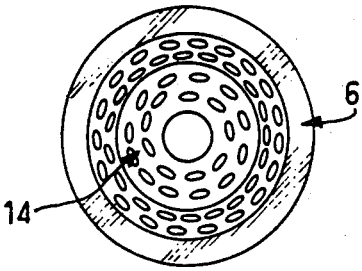

DEVICE FOR INCREASING THE UNIFORMITY OF THE AIR-FUEL MIXTURE IN INTERNAL COMBUSTION ENGINES

This is a division of application Ser. No. 851,971, filed Nov. 16, 1977, now U.S. Pat. No. 4,177,780.

The invention relates to a device for an internal combustion engine for increasing the uniformity of the air-fuel mixture.

As is known, the uniformity of the air-fuel mixture can be increased by producing turbulence, inter alia by means of one or more elements disposed downstream of the carburetor at the inlet of the intake manifold or pipe. Usually, the aforementioned elements comprise a venturi tube having a special shape or groove, in the form of a grid or helix. Each element provides only a single means of mixing, and some liquid particles are insufficiently divided, so that the mixture does not become very uniform.

The object of the invention is not only to produce turbulence but more particularly to precipitate the liquid particles at high speed on the walls, where they break up and produce a true aerosol. The resulting uniformity is excellent and there is no risk of letting through the particles which normally remain unburnt and are discharged to atmosphere, where they are responsible for a high proportion of pollution. Besides eliminating the risk of pollution, the device can use all the fuel in the mixture, thus saving from 10 to 30% of the fuel depending on the state of the engine. In addition, owing to the elimination of unburnt fuel producing carbon deposits, combustion is clean and there is an increase in the life of the ignition units (spark plugs) and of the moving parts (valves, pistons, etc.) and the engine in general.

According to the invention, the device comprises a frusto-conical element formed by a perforated lateral wall having a collar at its larger opening, the collar being adapted to fit between the carburetor flange and the manifold flange whereas the apex of the truncated cone extends into the manifold inlet, characterized in that the truncated cone has a single additional internal component secured to the wall, the additional component having one or more slopes disposed so that the stress of mixture from the carburetor strikes them and is divided and sprayed against the side wall, along which it travels and forms jets which subsequently strike the manifold wall.

The stream of mixture coming from the carburetor is divided in the frusto-conical element and, in spite of the perforations in the truncated cone, it has been found that all parts of the stream strike the wall at least once. For example, the particles on the periphery of the stream cannot travel directly through the perforations without impact, but are broken up by friction on the wall, the friction increasing downward owing to the reduction in the cross section of the truncated cone. Normally the center of the stream strikes the additional component even if some parts avoid striking it, they are entrained by the resulting turbulence and sprayed against the perforated wall. The various jets and vortices collide, thus completing the effect of the impacts on the central component and/or the wall. The parts of the stream sprayed against the wall do not all travel directly through the perforations, but some parts strike a solid region of the wall and are additionally mixed until they are finally ejected.

The mixing is so thorough that the minor base of the frusto-conical element need not be covered.

The internal component in the truncated cone is stationary and can have any appropriate shape, depending on the shape of the cone. It can form a turn in a spiral and bound sloping surface similar to those bounded by a spiral or helix. Alternatively, the internal component can have an endless surface forming a space surrounding the axis of the truncated cone.

In both cases the area of the perforations in the truncated element is greater than the area of its major opening on the carburetor side. The length of the cone is approximately two-thirds of the depth of the intake manifold inlet. The perforations are preferably circular and have the same or different diameters.

The additional component, which is disposed inside the truncated cone and in the form of a turn, is shaped and bent to form a stationary winding adapted to produce a vortex and drive the mixture against the walls of the truncated cone. The turn is secured to the cone wall; it can be solid or perforated. The base of the turn extends to or beyond the minor opening of the truncated cone, which extends into the manifold.

According to another embodiment, the turn can be replaced by a shape such as a small upturned centrally perforated cone having its base secured to the minor base of the truncated cone, whereas its perforated apex faces the major base.

The invention will be more clearly understood from the following specification with reference to the accompanying drawing, in which:

FIG. 1 is a general cross-sectional view showing the position of the additional component between the carburetor and the intake manifold;

FIG. 2 is a partial axial section showing one kind of frusto-conical element;

FIG. 3 is a top view of the same component (after removal of the carburetor);

FIG. 4 shows the turn in isolation;

FIG. 5 is a section through another kind of frusto-conical element, and

FIG. 6 is a plan view of the last-mentioned kind of frusto-conical element.

A frusto-conical element 5 has a wall 7 penetrating inside an intake manifold 4, and also has a collar 6 disposed between a flange 2 of a carburetor 1 and a flange 3 of manifold 4.

The frusto-conical element must be very strong. It can be manufactured in any appropriate manner.

The slope of the truncated cone is slight and its height depends on the depth of the manifold inlet. It can be more than two-thirds the aforementioned depth.

The cone wall 7 has perforations between 0.5 and 5 millimeters in diameter, the number of perforations being between 100 and 1,000. A single wall can have identical perforations or perforations of various diameters.

The turn may or may not be perforated. It is shaped to fit inside the truncated cone and its sides bear on wall 7.

Turn 9 is wound at 12 inside the cone, thus providing space for the butterfly valve 13 of carburetor 1.

Several weld points are used for securing turn 9 in cone 7. Thus, turn 9 is firmly secured in cone 7 and even if the plate accidentally comes loose it cannot be driven towards the engine, since the diameter of the minor base of the truncated cone is less than the length of the spiral.

When turn 9 has been disposed in cone 7 and the cone has been placed between carburetor 1 and manifold 4, its operation is as follows:

The stream of mixture leaving the carburetor enters the cone in the direction of arrow F; some of it strikes wall 7 in the direction of arrow f1 whereas another part strikes turn 10 and 11 in the direction of arrow f2, thus producing other turbulent streams f3, f4 which collide and are mainly ejected through perforations 8 in the direction of arrow f5, forming jets which strike the wall of manifold 4 and are driven downward past the walls and then mix with a small part of the internal turbulent mixture, which escapes at the base of the truncated cone in the direction of arrow f6.

During the successive impacts against the walls and between particles, the particles progressively break up until they are no longer detectable. The resulting very intensive mixing prevents harmful particles from reforming and rapidly drives the mixture to the engine.

To this end, the turn can be replaced by an upturned perforated cone 14 as shown in FIGS. 5 and 6. In the last-mentioned embodiment, the stream coming from the carburetor is divided, distributed all around the perforated cone, and driven back against wall 7 as before. The base of the inverted cone is firmly secured to the bottom end of wall 7.

I claim:

1. In a device for internal combustion engines for increasing the uniformity of the air-fuel mixture, comprising a frusto-conical element formed by a perforated lateral wall having a collar at its major opening, the collar being adapted to fit between the carburetor flange and the manifold flange of an internal combustion engine whereas the apex of the truncated cone extends into the manifold inlet of said engine; the improvement comprising a perforated truncated cone disposed inside said element and having its large base secured to the small base of said element and its small base extending in the direction of the large base of said element but terminating a substantial distance short of said large base of said element, both ends of said truncated cone being open.

2. A device according to claim 1, in which the perforations of said truncated cone are larger than those of said element.

3. A device according to claim 1, in which said truncated cone extends between one-third and one-half of the distance from said small end of said element toward said large end of said element.

4. A device according to claim 1, in which said collar extends radially outwardly and is joined directly to the frusto-conical element at the point where the frusto-conical element obtains its greatest diameter.

* * * * *